US010875051B2

(12) United States Patent
Evans et al.

(10) Patent No.: US 10,875,051 B2
(45) Date of Patent: Dec. 29, 2020

(54) PRODUCT PORTION ENROBING PROCESS AND APPARATUS

(71) Applicant: Altria Client Services LLC, Richmond, VA (US)

(72) Inventors: James David Evans, Chesterfield, VA (US); Andrew Nathan Carroll, Chester, VA (US); Shannon Maxwell Black, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 16/288,609

(22) Filed: Feb. 28, 2019

(65) Prior Publication Data

US 2019/0193110 A1 Jun. 27, 2019

Related U.S. Application Data

(62) Division of application No. 14/657,000, filed on Mar. 13, 2015, now Pat. No. 10,239,089.

(Continued)

(51) Int. Cl.
*B05B 7/14* (2006.01)
*B05B 12/36* (2018.01)

(Continued)

(52) U.S. Cl.
CPC ..... *B05D 1/12* (2013.01); *A24B 13/00* (2013.01); *A24B 15/186* (2013.01); *A24F 23/02* (2013.01);

(Continued)

(58) Field of Classification Search
USPC .... 118/300, 308, 62, 63; 427/200, 206, 462, 427/422, 424, 427.4; 425/72.2, 66;

(Continued)

(56) References Cited

U.S. PATENT DOCUMENTS 2,580,609 A 1/1952 Schur et al.
2,734,509 A 2/1956 Jurgensen, Jr.

(Continued)

FOREIGN PATENT DOCUMENTS

CN 101272703 A 9/2008
CN 101495002 A 7/2009

(Continued)

OTHER PUBLICATIONS

English Translation KR100857523, Sep. 8, 2008. (Year: 2008).*

(Continued)

*Primary Examiner* — Yewebdar T Tadesse
(74) *Attorney, Agent, or Firm* — Harness, Dickey & Pierce, P.L.C.

(57) ABSTRACT

An apparatus for enrobing a product portion can include a polymer spray head arranged to direct a plurality of polymeric fibers in an upward direction and levitate product portions in a polymer enrobing zone above the polymer spray head. Polymeric fibers produced by the polymer spray head can wrap around the product portions levitated in the polymer enrobing zone to create an enrobed product. Side guide structure(s) and/or air knife(s) can be provided adjacent to the polymer enrobing zone to inhibit levitated product portions from falling out of the polymer enrobing zone and/or to guide levitated product portions along a desired path. Exemplary enrobed products include smokeless tobacco products.

21 Claims, 6 Drawing Sheets

Related U.S. Application Data

(60) Provisional application No. 61/953,479, filed on Mar. 14, 2014.

(51) Int. Cl.

| | |
|---|---|
| ***B05D 1/12*** | (2006.01) |
| ***A24F 23/02*** | (2006.01) |
| ***B05D 1/06*** | (2006.01) |
| ***A24B 13/00*** | (2006.01) |
| ***A24B 15/18*** | (2006.01) |

(52) U.S. Cl.
CPC ..... *B05B 7/144* (2013.01); *B05B 12/36* (2018.02); *B05D 1/06* (2013.01)

(58) Field of Classification Search
USPC ..... 264/555
See application file for complete search history.

(56) References Cited

U.S. PATENT DOCUMENTS

| | | | | |
|---|---|---|---|---|
| 3,354,863 | A | 11/1967 | Reynolds et al. | |
| 4,084,627 | A | 4/1978 | Focke et al. | |
| 4,090,521 | A | 5/1978 | Elsner | |
| 4,380,570 | A | 4/1983 | Schwarz | |
| 4,405,688 | A | 9/1983 | Lowery et al. | |
| 4,516,590 | A | 5/1985 | Teng | |
| 4,526,733 | A | 7/1985 | Lau | |
| 4,528,993 | A | 7/1985 | Sensabaugh, Jr. et al. | |
| 4,660,577 | A | 4/1987 | Sensabaugh et al. | |
| 4,848,373 | A | 7/1989 | Lenkey | |
| 4,987,907 | A | 1/1991 | Townend | |
| 5,063,104 | A | 11/1991 | Robertson et al. | |
| 5,146,955 | A | 9/1992 | Steiner et al. | |
| 5,372,149 | A | 12/1994 | Roth et al. | |
| 5,476,616 | A | 12/1995 | Schwarz | |
| 5,528,993 | A | 6/1996 | Vincelli | |
| 5,645,790 | A | 7/1997 | Schwarz et al. | |
| 6,013,223 | A * | 1/2000 | Schwarz | D01D 5/0985 264/103 |
| 6,207,601 | B1 | 3/2001 | Maurer et al. | |
| 6,455,030 | B2 | 9/2002 | Saito et al. | |
| 6,716,498 | B2 | 4/2004 | Curro et al. | |
| 7,156,937 | B2 | 1/2007 | Provost et al. | |
| 7,465,366 | B2 | 12/2008 | Provost et al. | |
| 7,547,469 | B2 | 6/2009 | Provost et al. | |
| 7,562,426 | B2 | 7/2009 | Barker et al. | |
| 7,666,261 | B2 | 2/2010 | Bailey et al. | |
| 7,718,556 | B2 | 5/2010 | Matsuda et al. | |
| 7,810,507 | B2 | 10/2010 | Dube et al. | |
| 2001/0022988 | A1 | 9/2001 | Schwarz et al. | |
| 2004/0038022 | A1 | 2/2004 | Maugans et al. | |
| 2004/0118421 | A1 | 6/2004 | Hodin et al. | |
| 2004/0209540 | A1 | 10/2004 | Schwarz | |
| 2005/0056956 | A1 | 3/2005 | Zhao et al. | |
| 2005/0178398 | A1 | 8/2005 | Breslin et al. | |
| 2005/0196580 | A1 | 9/2005 | Provost et al. | |
| 2005/0196583 | A1 | 9/2005 | Provost et al. | |
| 2005/0217092 | A1 | 10/2005 | Barker et al. | |
| 2005/0244521 | A1 | 11/2005 | Strickland | |
| 2006/0191548 | A1 | 8/2006 | Strickland et al. | |
| 2006/0264130 | A1 | 11/2006 | Karles et al. | |
| 2007/0261707 | A1 | 11/2007 | Winterson et al. | |
| 2008/0209586 | A1 | 8/2008 | Nielsen et al. | |
| 2008/0277836 | A1* | 11/2008 | Park | D01D 5/0061 264/465 |
| 2008/0302682 | A1 | 12/2008 | Engstrom et al. | |
| 2008/0305297 | A1 | 12/2008 | Barker et al. | |
| 2008/0308115 | A1 | 12/2008 | Zimmermann | |
| 2009/0133703 | A1 | 5/2009 | Strickland et al. | |
| 2009/0189318 | A1 | 7/2009 | Kim | |
| 2009/0189319 | A1 | 7/2009 | Kim | |
| 2009/0203280 | A9 | 8/2009 | Provost et al. | |
| 2009/0256277 | A1 | 10/2009 | Brown et al. | |
| 2009/0258099 | A1 | 10/2009 | Brown et al. | |
| 2009/0258562 | A1 | 10/2009 | Brown et al. | |
| 2010/0018539 | A1 | 1/2010 | Brinkley et al. | |
| 2010/0018882 | A1 | 1/2010 | St Charles | |
| 2010/0018883 | A1 | 1/2010 | Patel | |
| 2010/0170522 | A1 | 7/2010 | Sun et al. | |
| 2010/0242978 | A1 | 9/2010 | Fuisz | |
| 2010/0300465 | A1 | 12/2010 | Zimmermann | |
| 2011/0036364 | A1 | 2/2011 | Pienemann et al. | |
| 2011/0083688 | A1 | 4/2011 | Mishra et al. | |
| 2011/0220130 | A1 | 9/2011 | Mua et al. | |
| 2012/0024301 | A1 | 2/2012 | Carroll et al. | |
| 2012/0031414 | A1 | 2/2012 | Atchley et al. | |
| 2012/0031416 | A1 | 2/2012 | Atchley et al. | |
| 2012/0103353 | A1 | 5/2012 | Sebastian et al. | |
| 2014/0261473 | A1* | 9/2014 | Carroll | A24B 15/186 131/118 |

FOREIGN PATENT DOCUMENTS

| | | | |
|---|---|---|---|
| CN | 101548797 | A | 10/2009 |
| CN | 101897809 | A | 12/2010 |
| CN | 103551046 | A | 2/2014 |
| DE | 10346649 | A1 | 5/2005 |
| EP | 0311364 | A2 | 4/1989 |
| EP | 1990448 | A2 | 11/2008 |
| EP | 2642556 | A2 | 9/2013 |
| GB | 2373988 | A | 10/2002 |
| JP | H05-255519 | A | 10/1993 |
| JP | 2002-176964 | A | 6/2002 |
| JP | 3872341 | B2 | 1/2007 |
| JP | 2007-515950 | A | 6/2007 |
| JP | 2009-203412 | A | 9/2009 |
| JP | 2012/199034 | A | 10/2012 |
| KR | 100857523 | B1 | 9/2008 |
| WO | WO-1995/20432 | A1 | 8/1995 |
| WO | WO-2001/51701 | A1 | 7/2001 |
| WO | WO-05/046363 | A2 | 5/2005 |
| WO | WO-2005/090653 | A1 | 9/2005 |
| WO | WO-2005/115180 | A1 | 12/2005 |
| WO | WO-07/37962 | A1 | 4/2007 |
| WO | WO-2008/015573 | A2 | 2/2008 |
| WO | WO-2009/063010 | A2 | 5/2009 |
| WO | WO-2009/065459 | A1 | 5/2009 |
| WO | WO-2010/078437 | A1 | 7/2010 |
| WO | WO-2011/130414 | A1 | 10/2011 |

OTHER PUBLICATIONS

European Search Report for corresponding Application No. 19175603.0-1105. dated Dec. 19, 2019.

"Air Knife—Wikipedia, the free encyclopedia", Jan. 27, 2014, XP055196211, Retrieved from the Internet: URL: http://web.archive.org/web/20140127191900/http://en.wikipedia.org/wiki/Air_knife [retrieed on Jun. 6, 2015] the whole document.

International Search Report for Application No. PCT/US2015/020454, dated Jun. 30, 2015, 15 pages.

Yarin et al., "Upward needleless electrospinning of multiple nanofibers", Plymer, Elsevier Science Publishers B.V, GB, vol. 45, No. 9, Apr. 1, 2004, p. 2977-2980, XP004499264, ISSN: 0032-3861, DOI: 10.1016/J.Polymer.2004.01.066 the whole document.

International Preliminary Report on Patentability for PCT/US/2011/046636 dated Feb. 14, 2013 (7 pages).

International Preliminary Report on Patentability for PCT/US2011/046625, dated Feb. 14, 2013, 6 pages.

International Search Report and Written Opinion in International Application No. PCT/US2014/028325, dated Sep. 8, 2014, 9 pages.

International Search Report and Written Opinion in International Application No. PCT/US2014/028354, dated Jul. 10, 2014, 12 pages.

International Search Report and Written Opinion in PCT/US2011/046636, dated Apr. 12, 2012, 14 pages.

International Search Report and Written Opinion in PCT/US2015/020449, dated Sep. 7, 2015, 13 pages.

International Search Report and Written Opinion in PCT/US2011/046625, dated Apr. 12, 2012, 12 pages.

(56) References Cited

OTHER PUBLICATIONS

International Search Report and Written Opinion in PCT/US2014/028584, dated Sep. 9, 2014, 6 pages.
Rydholm, Pulping Processes, Interscience Publishers, 1967, pp. 51-52.
Tso, Chapter 1 in Tobacco, Production, Chemistry and Technology, 1999, Davis & Nielsen, eds. Blackwell Publishing, Oxford.
International Preliminary Report on Patentability and Written Opinion in International Application No. PCT/US2015/020454, dated Sep. 14, 2016, 7 pages.

* cited by examiner

PRODUCT PORTION ENROBING PROCESS AND APPARATUS

CROSS REFERENCE TO RELATED APPLICATIONS

This is a divisional application of U.S. application Ser. No. 14/657,000, filed Mar. 13, 2015, which claims benefit under 35 U.S.C. § 119(e) to U.S. Application No. 61/953,479 filed on Mar. 14, 2014, the entire contents of each of which are incorporated herein by reference.

FIELD

This disclosure generally relates to processes and machines for enrobing product portions with polymeric fibers. In some cases, portions of smokeless tobacco can be enrobed in polymeric fibers to create a fiber-wrapped smokeless tobacco product.

BACKGROUND

Smokeless tobacco is tobacco that is placed in the mouth and not combusted. There are various types of smokeless tobacco including: chewing tobacco, moist smokeless tobacco, snus, and dry snuff. Chewing tobacco is coarsely divided tobacco leaf that is typically packaged in a large pouch-like package and used in a plug or twist. Moist smokeless tobacco is a moist, more finely divided tobacco that is provided in loose form or in pouch form and is typically packaged in round cans and used as a pinch or in a pouch placed between a cheek and gum of an adult tobacco consumer. Snus is a heat treated smokeless tobacco. Dry snuff is finely ground tobacco that is placed in the mouth or used nasally.

Smokeless Tobacco can be pouched in a permeable fabric using a pouching machine where a supply of pouching material is sealed around a deposit of smokeless tobacco material. Such a pouch holds the tobacco in place, while at the same time letting the flavors and substances of the tobacco pass through the walls of the pouch and into the mouth of an adult tobacco consumer. A conventional pouching machine may form a supply of pouching material around tube, seal the edges of the pouching material to form a tube of pouching material, form a cross-seal to form a bottom of the pouch, deliver an amount of smokeless tobacco through the tube and into the bottom-sealed pouch, move the bottom-sealed pouch off the tube, and form a second cross-seal above the smokeless tobacco to close the pouch. The second-cross-seal can also be used as the bottom seal for a subsequent pouch as the process continues. Individual pouches can be cut at the cross-seals.

SUMMARY

Methods and machines provided herein can be used to enrobe a product portion (e.g., a smokeless tobacco product portion) with polymeric fibers. Polymeric fiber enrobed product portions can be used in a number of consumer products, such as smokeless tobacco products and herbal products (e.g., tea). As compared to a conventional pouch made using a conventional pouching machine, a fiber-wrapped smokeless tobacco portion made using the methods and machines provided herein can have an improved mouth feel (e.g., no discernable seams), be more permeable, and/or be more chewable. Methods and machines provided herein can be used to efficiently and reliably enrobe multiple product portions.

Methods of enrobing a product portion in polymer strands provided herein can include directing a plurality of polymeric fibers from a polymer spray head in an upward direction to create an polymer enrobing zone above the polymer spray head and levitating at least one product portion in the polymer enrobing zone such that a plurality of polymeric fibers wrap around the at least one product portion. Product portions can be levitated in the polymer enrobing zone due to the flow of polymer and/or air exiting the polymer spray head.

Additional structures and/or flows of air can be positioned around the polymer enrobing zone such that product portions levitated in the polymer enrobing zone remain levitated in the polymer enrobing zone for a desired period of time and/or travel along a predetermined path. In some cases, at least one flow of air can be directed adjacent to the polymer enrobing zone to provide an air wall along at least one side of the polymer enrobing zone that can redirect a product portion falling out of the polymer enrobing zone back into the polymer enrobing zone. For example, a wall of air produces a laminar air flow that acts as an air knife such that tumbling product portions that enter the laminar air flow are pushed back into the polymer enrobing zone by the laminar air flow, which can cause the tumbling product portions to spin. In some cases, a second flow of air can provide an opposite air wall (e.g., a second air knife) along an opposite side of the polymer enrobing zone. In some cases, the air flows can include heated air. In some cases, the heated air in an air flow from an air knife can have a temperature of between 300 degrees Fahrenheit and 450 degrees Fahrenheit.

Side guide structures can also be used to inhibit product portions from falling out of the polymer enrobing zone. In some cases, side guide structures can be used with adjacent air flows to inhibit product portions from falling out of the polymer enrobing zones. In some cases, side guide structures can be used without adjacent air flows. Guide structures can be positioned on opposite sides of a polymer enrobing zone adjacent to sides of the polymer spray head such that product portions traveling outside of the polymer enrobing zone can bounce off the guide structures and back into the polymer enrobing zone. In some cases, the guide structures are side guide conveyors. The side guide conveyors can move a conveyor belt in a direction orthogonal to the flow direction of the polymer fibers out of the polymer spray head. Side guide conveyors moving a conveyor surface in a direction towards one end of a polymer spray head can direct product portions towards that end of the polymer enrobing zone.

Methods provided herein can include introducing one or more product portions at a first end of a polymer enrobing zone and collecting one or more enrobed product portions at a second end of the polymer enrobing zone. In some cases, side conveyors can move in a direction towards the second collection end of the polymer enrobing zone. In some cases, the polymer spray head is inclined such that a product portion introduced to the polymer enrobing zone at the first end of the polymer enrobing zone above the side having a higher elevation will preferentially exit the polymer enrobing zone at the second end of the polymer enrobing zone above the side having lower elevation. In some cases, the polymer spray head can be inclined at an angle of between 5 degrees and 50 degrees. In some cases, the polymer spray head can be inclined at an angle of between 10 degrees and 30 degrees. In some cases, a polymer spray head can direct the polymer fibers at an angle of less than 90 degrees from the polymer spray head to impart a directional flow of polymers in the polymer enrobing zone.

Methods provided herein can include a process of collecting at least some of the plurality of polymeric fibers on a polymer collection roller positioned above the polymer enrobing zone. In some cases, fibers collected on the polymer collection roller can be recycled or used to make additional products.

An apparatus for enrobing a product portion provided herein can include a polymer spray head arranged to direct a plurality of polymeric fibers in an upward direction and levitate product portions in a polymer enrobing zone above the polymer spray head. An apparatus provided herein can include at least one side guide structure and/or air knife adapted to retain levitated product portions in the polymer enrobing zone. In some cases, an apparatus provided herein includes at least one side guide adjacent to the polymer enrobing zone. In some cases, an apparatus provided herein includes at least two side guides on opposite sides of the polymer enrobing zone. In some cases, an apparatus provided herein includes a side guide conveyor adapted to move a conveyor in a direction orthogonal to the direction of polymer flow. In some cases, an apparatus provided herein includes at least one air knife adapted to direct a flow of air adjacent to the polymer enrobing zone to create an air wall that can redirect levitated product portions falling out of the polymer enrobing zone back into the polymer enrobing zone. In some cases, an apparatus provided herein includes at least two air knifes located on opposite sides of the polymer enrobing zone. In some cases, an apparatus provided herein includes a polymer collection roller above the polymer enrobing zone adapted to collect polymeric fibers that are not wrapped around product portions levitated in the polymer enrobing zone. In some cases, an apparatus provided herein includes a polymer spray head that is elongated and inclined such that a first end is at a higher elevation than a second end. In some cases, an apparatus provided herein includes an adjustable tilt adapted to adjust an incline of the apparatus. In some cases, the tilt can be adjusted to tilt the polymer spray head at multiple angles between 0 degrees and 50 degrees, between 5 degrees and 30 degrees, or between 10 degrees and 20 degrees.

Product portions enrobed in methods and machines provided herein can be any suitable product. Product portions enrobed herein can be products with sufficient integrity to not fall apart when levitated within the polymer enrobing zone. In some cases, product portions enrobed in methods provided herein include consumable products (e.g., tobacco, herbal products such as teas, mint, etc.). In some cases, product portions enrobed in methods provided herein have an overall oven volatiles content of about 4% by weight to about 61% by weight. In some cases, a binder can be included in the product portion to have the product portion retain its integrity during the enrobing process provided herein. In some cases, a product portion can include between 0.1 and 0.5 weight percent of a binder. Suitable binders include guar gum, xanthan gum, cellulose gum, and combinations thereof. In some cases, pre-hydrated Arabic gum can be used in product portions (e.g., smokeless tobacco products) to act as an emulsifier to increase/improve flavor immediacy.

In some cases, a fiber-wrapped product portion produced using methods and machines provided herein can include a plurality of polymeric fibers surrounding the product portion. The polymeric fibers overlying the product portion can have a basis weight of 30 grams per square meter (gsm) or less, 30 gsm or less, 20 gsm or less, 10 gsm or less, or 5 gsm or less. The polymeric fibers can have diameters of less than 100 microns. In some cases, the polymeric fibers are melt-blown polymeric fibers. In some cases, the polymeric fibers are force-spun polymeric fibers. In some cases, an electrostatic charge can be applied to the plurality of polymeric fibers, one or more product portions, or a combination thereof. In some cases, a spin is applied to the product portions when passing through the polymer enrobing zone. In some cases, the polymer fibers wrap and seal the body of the product portions simultaneously. In some cases, combinations of mouth-stable and mouth-dissolvable polymeric materials are combined to form a fiber-wrapped product portion that becomes looser when consumed, yet remains generally cohesive. The polymeric fibers can also be a composite of multiple materials, which may include both mouth-stable and mouth-dissolvable materials.

In some cases, a method of preparing a fiber-wrapped smokeless tobacco product includes melt-blowing or centrifugal force spinning a plurality of polymeric fibers from a polymer spray head to create a polymer enrobing zone above a polymer spray head and passing a body comprising smokeless tobacco through the polymer enrobing zone. The fiber-wrapped smokeless tobacco products produced using methods and machines provided herein provide a unique tactile and flavor experience to an adult tobacco consumer. In particular, the polymeric fibers can provide a smoother mouth texture and improved access to the smokeless tobacco, improved porosity, and improved fluid exchange as compared to a traditional pouching material, but still retain the smokeless tobacco. Moreover, the methods provided herein can result in a seamless wrapping of polymeric fibers, which can reduce mouth irritation. Furthermore, the polymeric fibers provided herein can be more elastic and can permit an adult tobacco consumer to chew/squeeze the fiber-wrapped smokeless tobacco product and mold the product into a desired shape (e.g., to comfortably conform the product between the cheek and gum). As compared to a typical pouch paper, the fiber wrappings produced using methods and machines provided herein can be softer, have a lower basis weight, and act as less of a selective membrane. Additionally, methods and machines provided herein avoid a need to use a cutting device and a sealing device, which are commonly used in conventional packaging machines.

The products and methods described herein can also be applied to other orally consumable plant materials in addition to smokeless tobacco. For example, some non-tobacco or "herbal" compositions have also been developed as an alternative to smokeless tobacco compositions. Non-tobacco products may include a number of different primary ingredients, including but not limited to, tea leaves, red clover, coconut flakes, mint leaves, citrus fiber, bamboo fiber, ginseng, apple, corn silk, grape leaf, and basil leaf. In some cases, such a non-tobacco smokeless product can further include tobacco extracts, which can result in a non-tobacco smokeless product providing a desirable mouth feel and flavor profile. In some cases, the tobacco extracts can be extracted from a cured and/or fermented tobacco by mixing the cured and/or fermented tobacco with water and/or other solvents and removing the non-soluble tobacco material. In some cases, the tobacco extracts can include nicotine. In some cases, a pouched non-tobacco product has an overall oven volatiles content of between 10 and 61 weight percent.

Unless otherwise defined, all technical and scientific terms used herein have the same meaning as commonly understood by one of ordinary skill in the art to which the methods and compositions of matter belong. Although methods and materials similar or equivalent to those described herein can be used in the practice or testing of the methods and compositions of matter, suitable methods and materials are described below. In addition, the materials, methods, and examples are illustrative only and not intended to be limiting. All publications, patent applications, patents, and other references mentioned herein are incorporated by reference in their entirety.

DESCRIPTION OF DRAWINGS

Like reference symbols in the various drawings indicate like elements.

DETAILED DESCRIPTION

Methods and machines provided herein can be used to enrobe one or more product portions (e.g., smokeless tobacco product portions) with polymeric fibers. Methods and machines provided herein can be used to efficiently and reliably enrobe multiple product portions while providing gentle handling of the product portions. For example, smokeless tobacco portions enrobed by process and machines provided herein can have a high friability prior to enrobing. Methods and machines provided herein can distribute polymeric fibers onto a product portion evenly across all surfaces of a product portion while minimizing the strain on the product portions. In some cases, methods and machines provided herein can achieve a uniform application of polymeric fibers on all sides of multiple product portions in an automated process.

Methods and machines provided herein levitate product portions in a polymer enrobing zone above a polymer spray head. By levitating product portions, the product portions can rotate freely, tumble, and shift during the process to thus receive substantially complete coverage of all surfaces. Methods and machines provided herein can use a variety of techniques to keep product portions levitated in the polymer enrobing zone (at least for a desired amount of time) and/or to guide the flow of product portions through the process/apparatus. The flow of polymeric fibers out of the polymer spray head can provide sufficient upward force to counteract gravity and keep product portions levitated in the polymer enrobing zone. In some cases, a polymer spray head can provide additional streams of fluids (e.g., air) that can also provide force to levitate the product portions. In some cases, a laminar fluid flow around a polymer enrobing zone can help retain product portions within the polymer enrobing zone. Laminar fluid flows (e.g., hot air knives) around the polymer enrobing zone can provide a wall of fluid that helps guide the product back towards the center of the polymer enrobing zone. Side guides can also be positioned around the polymer enrobing zone to prevent product portions from exiting the polymer enrobing zone. Side guides can be conveyors in some cases. Product portions can be introduced at one end of the polymer enrobing zone above a first end of the polymer spray head, bounce around between the laminar fluid flows and/or side guides, and exit the polymer enrobing zone towards a second end of the polymer spray head. In some cases, side guide conveyors can include conveying surfaces that move towards the second end of the polymer spray head. In some cases, the surface of the polymer spray head, or the polymer spraying nozzles of the polymer spray head, can be tilted towards the second end to direct product portions towards the desired exit side of the polymer enrobing zone.

Figure 1:
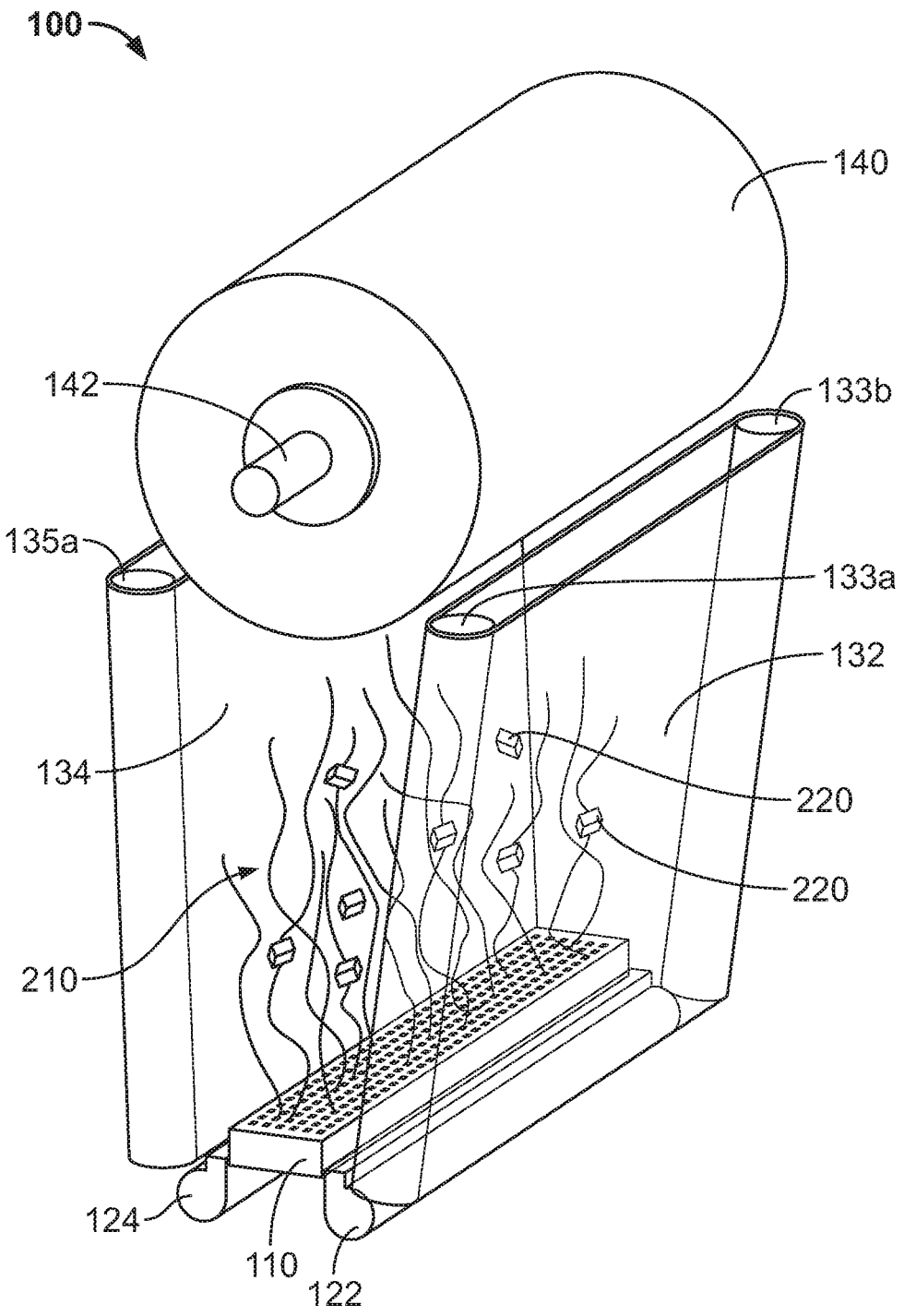
FIG. 1 depicts an exemplary apparatus for enrobing product portions.
Figure 2:
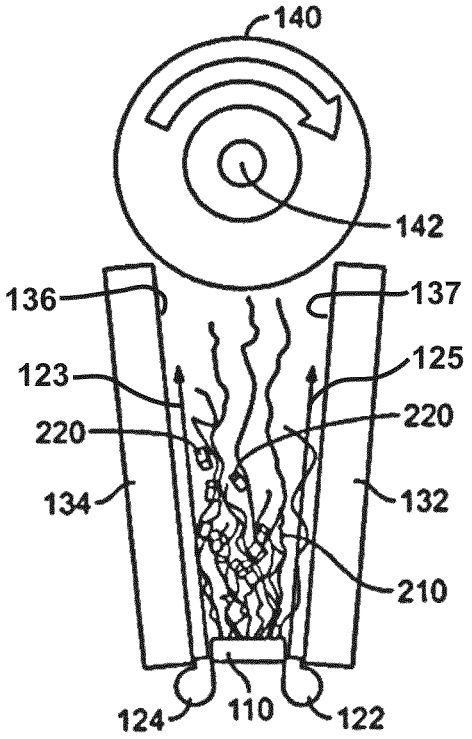
FIG. 2 illustrates how the exemplary apparatus of FIG. 1 can be used to enrobe product portions.
Figure 3:
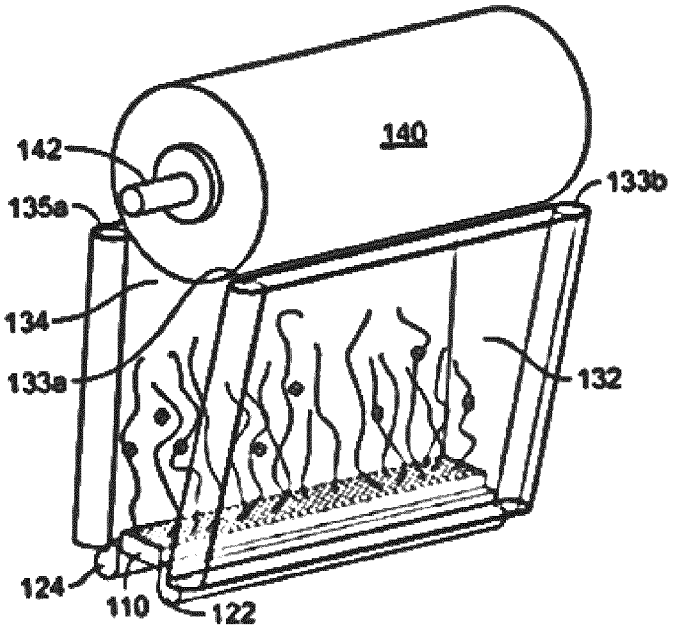
FIG. 3 depicts a side perspective view of the exemplary apparatus of FIG. 1.

FIGS. 1-4 depict an exemplary product enrobing apparatus 100 provided herein. FIG. 2 further depicts how product portions 220 can be enrobed by polymeric fibers 210 in the polymer enrobing zone 200. As shown in FIGS. 1-4, the apparatus 100 can include a polymer spray head 110, air knives 122 and 124, side guide conveyors 132 and 134, and a polymer collection roller 140. As shown in FIG. 2, polymer spray head 110 can produce an upward flow of polymeric fibers 210 in the polymer enrobing zone 200. Product portions 220 can be levitated in the polymer enrobing zone 200 due to the upward flow of polymeric fibers 210 and other fluid flows (e.g., air used to produce the polymeric fibers and/or air flows 123 and 125 produced by air knifes 122 and 124). As product portions 220 rotate, tumble, and/or shift in the polymer enrobing zone 200, polymeric fibers 210 can randomly wrap around each product portion 220 to produce an enrobed product, such as those shown in FIG. 5 (discussed below).

Polymer Spray Head & Polymer Fibers

Polymer spray head 110, in some cases, produces polymeric fibers 210 by melt-blowing, electro spinning, and/or centrifugal force spinning, which are each described below. The polymer can be any suitable polymers usable in a melt-blowing, electro spinning, and/or centrifugal force spinning process, such as polypropylene, polyurethane, styrene, cellulose, polyethylene, PVC, EVA (ethyl vinyl acetate), viscose, polyester, and PLA. In some cases, polymeric fibers 210 can be quenched (i.e., rapidly cooled to below their melt temperature) prior to or upon contacting product portions 220. For example, water or other liquid can be sprayed into a polymeric fiber stream as it exits the polymer spray head 110. In some cases, the polymeric fibers can be quenched with a surfactant. In some cases, the polymeric fibers can be cooled to below the melt temperature after contact with product portions 220.

Polymeric fibers 210 can have a diameter of less than 100 microns, less than 50 microns, less than 30 microns, less that 10 microns, less than 5 microns, less than 1 microns, less that 0.5 microns, less than 0.1 microns, less than 0.05 microns, or less than 0.01 microns. In some cases, melt-blown polymeric fibers 210 used in methods and machines provided herein can have a diameter of between 0.5 and 5 microns. In some case, force-spun polymeric fibers 210 used in methods and machines provided herein can have a diameter of between 10 nanometers and 1 micron. The flow of the polymeric fibers and the dimensions of the polymeric fibers as they exit a melt blowing or centrifugal force spinning apparatus can result in an intimate contact between the fibers and the smokeless tobacco such that the polymeric fibers conform to the surface topography of the fibrous tobacco structures.

Figure 6:
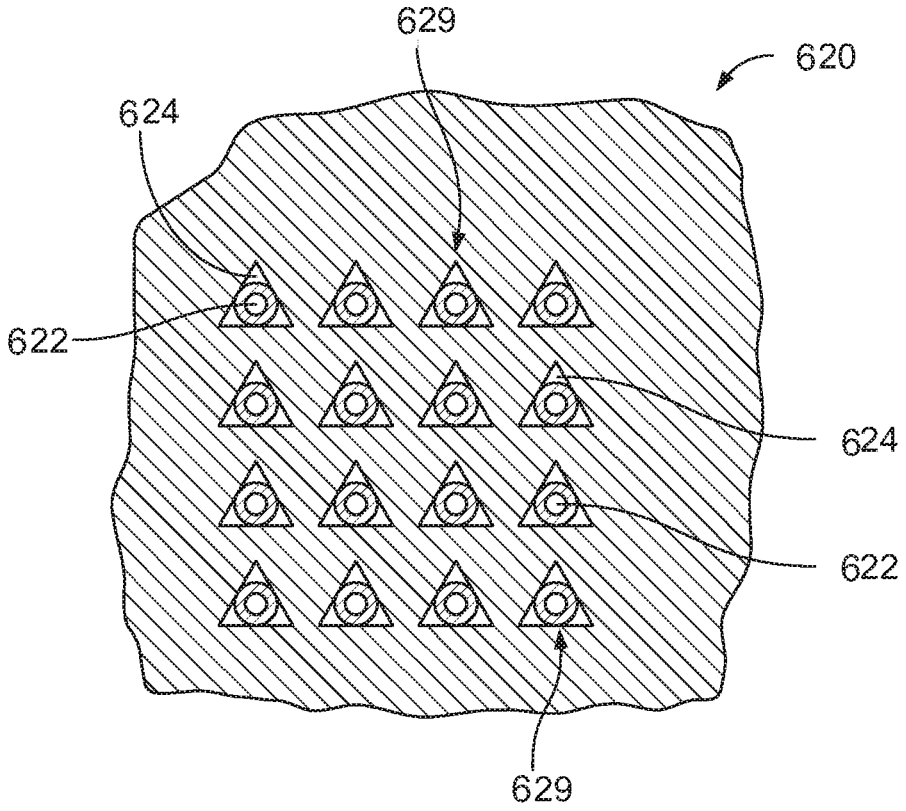
FIG. 6 depicts an exemplary arrangement of polymer orifices and air orifices for a polymer spray head.

In some cases, polymer spray head 110 is a melt-blowing device. Melt-blowing is an extrusion process where molten polymeric resins are extruded through an extrusion die (e.g., a spinneret) and gas is introduced to draw the filaments to produce polymeric fibers. The gas can be heated air blown at high velocity through orifices that surround each spinneret or in air slots around each individual spinneret. In some cases, layers of hot air are blown through slots between rows of spinnerets—the strands of polymeric material are attenuated by being trapped between two layers of air. Other methods of delivering the attenuating gas (e.g., heated air) are possible. FIG. 6 depicts an exemplary arrangement of polymer orifices and air orifices for a melt-blowing device 620 used as polymer spray head 110. Other melt-blowing devices are described in U.S. Pat. Nos. 4,380,570; 5,476,616; 5,645,790; and 6,013,223 and in U.S. Patent Applications US 2004/0209540; US 2005/0056956; US 2009/0256277; US 2009/0258099; and US 2009/0258562, which are hereby incorporated by reference.

A melt-blowing device 620 can include a polymer extruder that pushes molten polymer at low or high melt viscosities through a plurality of polymer orifices 622. The melt-blowing device 620 includes one or more heating devices that heat the polymer as it travels through the melt-blowing device 620 to ensure that the polymer remains above its melting point and at a desired melt-blowing temperature. As the molten polymer material exits the polymer orifice 622, the polymer material is accelerated to near sonic velocity by gas being blown in parallel flow through one or more air orifices 624. The air orifices 624 can be adjacent to the polymer orifices 622. The air orifices 624 may surround each polymer orifice 622. In some cases, the air orifices 624 can be rounded. Each combination of a polymer orifice 622 with surrounding air orifices 624 is called a spinneret 629. For example, the melt-blowing device 620 can have between 10 and 500 spinnerets 629 per square inch. The polymer orifices 622 and the gas velocity through gas orifices 624 can be combined to form fibers of 100 microns or less. In some cases, the spinnerets each have a polymer orifice diameter of 30 microns or less. In some cases, the fibers have diameters of between 0.5 microns and 5 microns. The factors that affect fiber diameter include throughput, melt temperature, air temperature, air pressure, spinneret design, material, distance from the drum, spinneret design, and material being processed. In some cases, the spinnerets 629 each have a polymer orifice diameter of less than 900 microns. In some cases, the spinnerets 629 each have a polymer orifice diameter of at least 75 microns. The average polymer orifice diameter can range from 75 microns to 1800 microns. In some cases, the average polymer orifice diameter can be between 150 microns and 400 microns. In some cases, polymer orifice diameters of about 180 microns, about 230 microns, about 280 microns, or about 380 microns are used. In some cases, some spinnerets can also include orifices that provide air flows without polymer to provide additional attenuation and direction of polymer fibers produced from other spinnerets.

In some cases, polymer spray head 110 can be an electro spinning apparatus spins fibers of diameters ranging from 10 nm to several hundred nanometers. In some cases, electro spun polymers are dissolved in water or organic solvents. The electro spinning process makes use of electrostatic and mechanical force to spin fibers from the tip of a fine orifice or spinneret. The spinneret is maintained at positive or negative charge by a DC power supply. When the electrostatic repelling force overcomes the surface tension force of the polymer solution, the liquid spills out of the spinneret and forms an extremely fine continuous filament. These filaments are collected onto a rotating or stationary collector with an electrode beneath of the opposite charge to that of the spinneret where they accumulate and bond together to form nanofiber web.

In some cases, polymer spray head 110 can be a centrifugal force spinning apparatus that uses centrifugal force is used to create and orient polymeric fibers. In some case, polymer spray head 110 can include a spinneret that holds polymeric material and is rotated at high speeds with a motor to produce polymeric fibers. As the spinneret rotates, the polymeric material (in a liquid state) can be pushed to the orifices lining the outer wall of the spinneret. As the polymeric material enters the orifice chamber, molecules disentangle and then align directionally. Centrifugal and hydrostatic forces combine to initiate a liquid material jet. The external aerodynamic environment combined with the inertial force of continued rotation further applies shear forces and promote cooling and/or solvent evaporation to further stretch the fiber. The inertia force can stretch molecular chains into the nanoscale and the air turbulence can apply a shear force. A product portion can be levitated in upward flowing streams of centrifugal force spun polymer to produce an enrobed product portion. In some cases, centrifugal force spun fibers can improve a web strength and random orientation of polymeric fibers deposited onto a product portion due to a long fiber length.

In some cases, polymeric fibers 210 include elastomeric polymers (e.g., polyurethane). Elastomeric polymers can provide webs with improved elongation and toughness. In some cases, an elastomeric polymer smokeless tobacco product portion provided herein can provide the unique property of allowing an adult tobacco consumer to reduce or increase a packing density of the elastomeric polymer smokeless tobacco product portion, which can impact a rate of flavor release. A higher packing density can reduce a rate of flavor release. In some cases, polymeric fibers used in methods and machines provided herein can be hydrophilic, which can provide a moist appearance and/or provide superior flavor release. Suitable elastomeric polymers include EPAMOULD (Epaflex), EPALINE (Epaflex), TEXIN (Bayer), DESMOPAN (Bayer), HYDROPHAN (Advance-Sourse Biomaterials), ESTANE (Lubrizol), PELLETHANE (Lubrizol), PEARLTHANE (Merquinsa), IROGRAN (Huntsman), ISOTHANE (Greco), ZYTHANE (Alliance Polymers and Services), VISTAMAX (ExxonMobil), and MD-6717 (Kraton). In some cases, elastomers can be combined with polyolefins at ratios ranging from 1:9 to 9:1. For example, elastomeric polymers can be combined with polypropylene. In some cases, a blend of polyurethane, polypropylene, and styrene can be compounded and used to make polymeric fibers in methods and machines provided herein.

Figure 7:
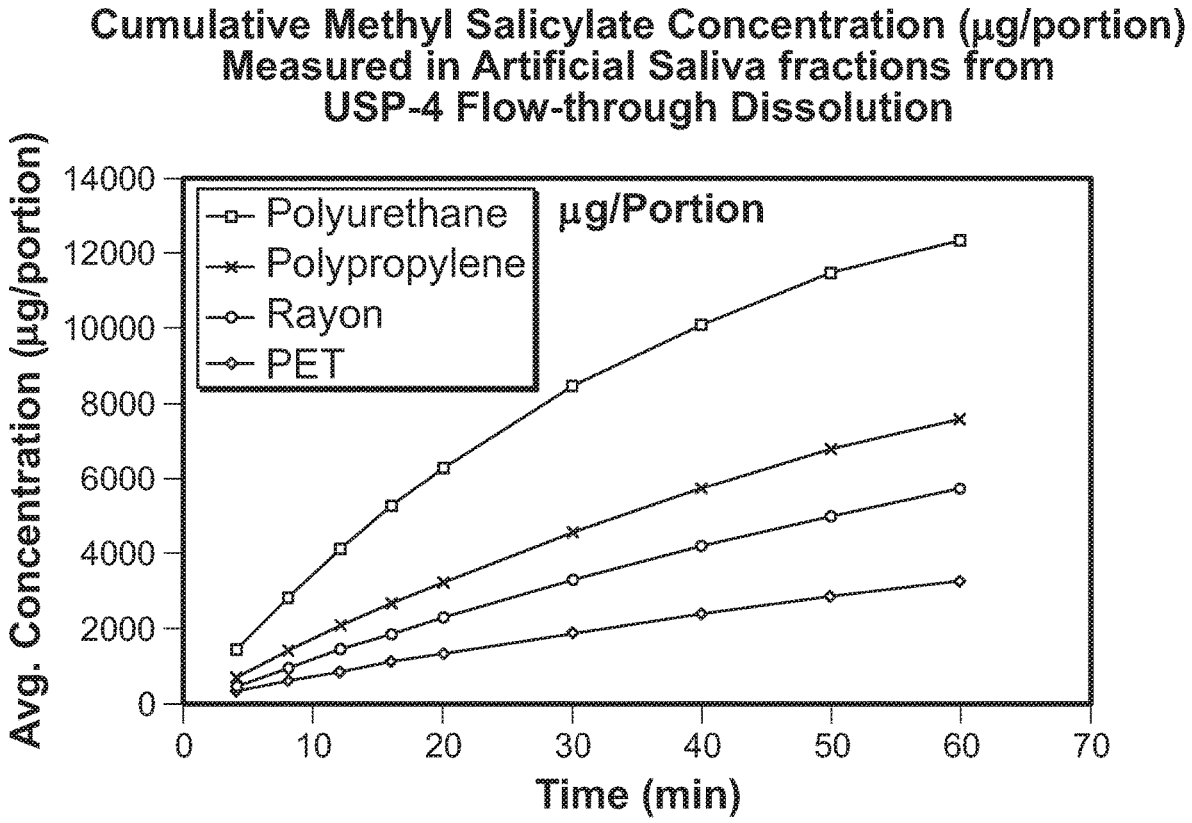
FIG. 7 depicts a chart comparing release rates of methyl sallylate from pouches made of different materials.

Hydrophilic materials can wick fluids there through and/or give a pouched product a moist appearance. For example, polyurethane polymer fibers can also provide faster and higher cumulative flavor release as compared to non-elastic polymer fiber such as rayon, polypropylene, and polyethylene terephthalate (PET). FIG. 7 depicts the cumulative methyl sallcylate concentration (m/portion) measured in artificial saliva fractions from USP-4 flow-through dissolution pouches made of polyurethane, polypropylene, rayon, and PET. Due to polyurethanes relatively high level of elasticity and natural hydrophilic properties, flavor is able to traverse polyurethane pouching material easier than non-elastomeric nonwoven substrates.

In some cases, polymeric fibers 210 are mouth-stable fibers. The mouth-stable fibers can have low extractables, are approved for use with food, and/or be manufactured by suppliers who are GMP approved. Highly desirable are materials that are easy to process and relatively easy to approve for oral use (e.g. quality, low extractables, approved by regulators, suppliers are GMP approved). In some cases, the mouth-stable structural fibers are elastomers. Elastomers can provide webs with improved elongation and toughness. Suitable elastomers include VISTAMAX (ExxonMobil), TEXIN RXT70A (Bayer), and MD-6717 (Kraton). In some cases, elastomers can be combined with polyolefins at ratios ranging from 1:9 to 9:1. For example, elastomers (such as VISTAMAX or MD-6717) can be combined with polypropylene.

Mouth-dissolvable fibers could be made from hydroxypropyl cellulose (HPC), methyl hydroxypropyl cellulose (HPMC), polyvinyl alcohol (PVOH), PVP, polyethylene oxide (PEO), starch and others. Fibers 210 can in some cases include contain flavors, sweeteners, milled tobacco and other functional ingredients. In some cases, mouth dissolvable fibers can be combined with mouth-stable fibers to enrobe the product portions 220 as provided herein.

Colorants and/or fillers can also be added to the polymer in the polymer spray head 110. The hydraulic permittivity of the enrobing coating of polymeric fibers can also be increased by compounding the polymer with a filler prior to forming the polymeric fibers. The hydraulic permittivity is the rate of fluid transfer through a substrate. In some cases, a colorant can be used as the filler. For example, a brown colorant can be added to a feed hopper of an extruder along with a polymer material (e.g., polypropylene or polyurethane) prior to melt blowing the polymer into the fibers. In addition to improving the hydraulic permittivity, the colorant can improve the aesthetic appeal of the fiber-wrapped product portion. For example, a brown colorant can make a wrapped moist-smokeless tobacco product appear moist.

As discussed above, the polymeric fibers can contact product portions 220 at a temperature greater than the melt temperature of the polymer. In some cases, however, the polymeric fibers can be quenched and/or treated with a surfactant prior to contacting the product portions 220. Water vapor can be used to cool the polymeric material. For example, water vapor from a spout can be directed into a stream of molten strands of polymeric material exiting the polymer spray head 110 to "quench" the polymeric strands and form the fibers. For example, a mist can be aimed towards the spinnerets 629 of the melt-blowing spray device 620. A fine mist of water vapor or surfactant or air can quickly cool the strands below the polymer melt temperature. In some cases, quenched melt-blown fibers can have improved softness and fiber/web tensile strength.

A surfactant treatment can also be applied to polymeric fibers 210. In some cases, a surfactant is applied to the polymeric fibers as they exit the spinnerets of the polymer spray head 110. In some cases, surfactant can be applied as a mist (either with or without water). In some cases, the surfactant applied as a mist can quench the polymeric fibers. In some cases, the surfactant can be applied in an extrusion process. In some cases, a mixture of water and surfactant can be atomized and applied as mist. Sweeteners and/or flavorants can also be atomized and applied to the polymeric fibers as mist.

Quenching the polymer can modify the crystallinity of the polymer material to improve tensile strength and mouth feel. The surfactant can improve the hydraulic permittivity of the coating of polymeric fibers (e.g., to improve moisture and flavor release from an enrobed smokeless tobacco product). The hydraulic permittivity is the rate of fluid transfer through a substrate.

Suitable polymeric materials for use in methods and machines provided herein include one or more of the following polymer materials: acetals, acrylics such as polymethylmethacrylate and polyacrylonitrile, alkyds, polymer alloys, allyls such as diallyl phthalate and diallyl isophthalate, amines such as urea, formaldehyde, and melamine formaldehyde, epoxy, cellulosics such as cellulose acetate, cellulose triacetate, cellulose nitrate, ethyl cellulose, cellulose acetate, propionate, cellulose acetate butyrate, hydroxypropyl cellulose, hydroxypropyl methyl cellulose, carboxymethyl cellulose, cellophane and rayon, chlorinated polyether, coumarone-indene, epoxy, polybutenes, fluorocarbons such as PTFE, FEP, PFA, PCTFE, ECTFE, ETFE, PVDF, and PVF, furan, hydrocarbon resins, nitrile resins, polyaryl ether, polyaryl sulfone, phenol-aralkyl, phenolic, polyamide (nylon), poly (amide-imide), polyaryl ether, polycarbonate, polyesters such as aromatic polyesters, thermoplastic polyester, PBT, PTMT, (polyethylene terephthalate) PET and unsaturated polyesters such as SMC and BMC, thermoplastic polyimide, polymethyl pentene, polyolefins such as LDPE, LLDPE, HDPE, and UHMWPE, polypropylene, ionomers such as PD and poly allomers, polyphenylene oxide, polyphenylene sulfide, polyurethanes (such as DESMOPAN DP 9370A available from Bayer), poly p xylylene, silicones such as silicone fluids and elastomers, rigid silicones, styrenes such as PS, ADS, SAN, styrene butadiene latricies, and styrene based polymers, suflones such as polysulfone, polyether sulfone and polyphenyl sulfones, polymeric elastomers, and vinyls such as PVC, polyvinyl acetate, ethyl vinyl acetate, polyvinylidene chloride, polyvinyl alcohol, polyvinyl butyrate, polyvinyl formal, propylene-vinyl chloride copolymer, ethylvinyl acetate, and polyvinyl carbazole, polyvinyl pyrrolidone, and polyethylene oxide, ethylene vinyl alcohol, sugar alcohols, and starches.

The amount of polymeric material used depends on the final use of the enrobed product portion. For an enrobed smokeless tobacco product, the amount can depend on the desired flavor profile and desired mouth feel. In some cases, an enrobed product portion includes less than 200 mg of polymer per product portion 220. In some cases, a single enrobed product portion can include between 5 and 100 mg of polymeric material, between 60 and 80 mg of polymeric material, between 10 and 50 mg of polymeric material, or between 25 and 75 mg of polymeric material. In some cases, an enrobed product portion includes between 0.1% and 10% by weight of polymeric material, between 0.4% and 5% by weight of polymeric material, between 0.5% and 2% by weight of polymeric material, between 2% and 4% by weight of polymeric material, or between 1% and 3% by weight of polymeric material. In some cases, the basis weight of the wrapping of polymeric fibers on an enrobed product portion can have a basis weight of less than 30 gsm, less than 25 gsm, less than 20 gsm, less than 15 gsm, less than 10 gsm, less than 5 gsm, less than 4 gsm, less than 3 gsm, less than 2 gsm, or less than 1 gsm. In some cases, the wrapping of polymeric fibers on an enrobed product portion can have a basis weight of between 0.5 gsm and 4 gsm, between 1 gsm and 3 gsm, or of about 2 gsm.

Polymer Enrobing Zone

In methods and machines provided herein, such as depicted in FIG. 2, product portions 220 are levitated in a polymer enrobing zone 200 above polymer spray head 110, so that polymeric fibers 210 can wrap around and enrobe product portions 220. Product portions 220 can be levitated in polymer enrobing zone 200 due to the flow of polymeric fibers 200 and/or air exiting the polymer spray head. Additional structures and/or flows of air can be positioned around the polymer enrobing zone 200 such that product portions 220 levitated in polymer enrobing zone 200 remain levitated in polymer enrobing zone 200 for a desired period of time and/or travel along a predetermined path. As shown in FIG. 2, air knives 122 and 124 can produce air flows 123 and 125 on opposite sides of polymer enrobing zone 200. Also shown in FIG. 2, side guides 132 and 134 can be positioned on opposite sides of polymer enrobing zone 200.

Air knives 122 and 124 can provide air walls 123 and 125 adjacent to polymer enrobing zone 200 that can redirect a product portion falling out of polymer enrobing zone 200 back into polymer enrobing zone 200. For example, air walls 123 and 125 can push tumbling product portions 220 back into polymer enrobing zone 200. In some cases, air walls 123 and 125 can cause the tumbling product portions to spin when returning to polymer enrobing zone, which can product a random and substantially uniform coverage of the sides of each product portion 220. In some cases, air knives 122 and 124 can provide a flow of air having a temperature of between 300 degrees Fahrenheit and 450 degrees Fahrenheit.

Side guides 132 and 134 can inhibit product portions 220 from falling out of polymer enrobing zone 200. In some cases, side guides 132 and 134 can be used with adjacent air knives 122 and 124 to inhibit product portions from falling out of polymer enrobing zones 200. In some cases, side guides 132 and 134 can be used without adjacent air flows. Guide structures 132 and 134 can be positioned on opposite sides of polymer enrobing zone 200 adjacent to sides of polymer spray head 110 such that product portions 220 traveling outside of polymer enrobing zone 200 can bounce off guide structures 132 and 134 and back into polymer enrobing zone 200. In some cases, such as shown in FIGS. 1-4, guide structures 132 and 134 are side guide conveyors. Side guide conveyors 132 and 134 can move a conveyor belt 133 and 134 in a direction orthogonal to the flow direction of polymeric fibers 210 exiting polymer spray head 110. Side guide conveyors 132 and 134 moving conveyor surfaces 136 and 137 in a direction towards one end of polymer spray head 110 can direct product portions towards that end of polymer enrobing zone 200.

Figure 4:
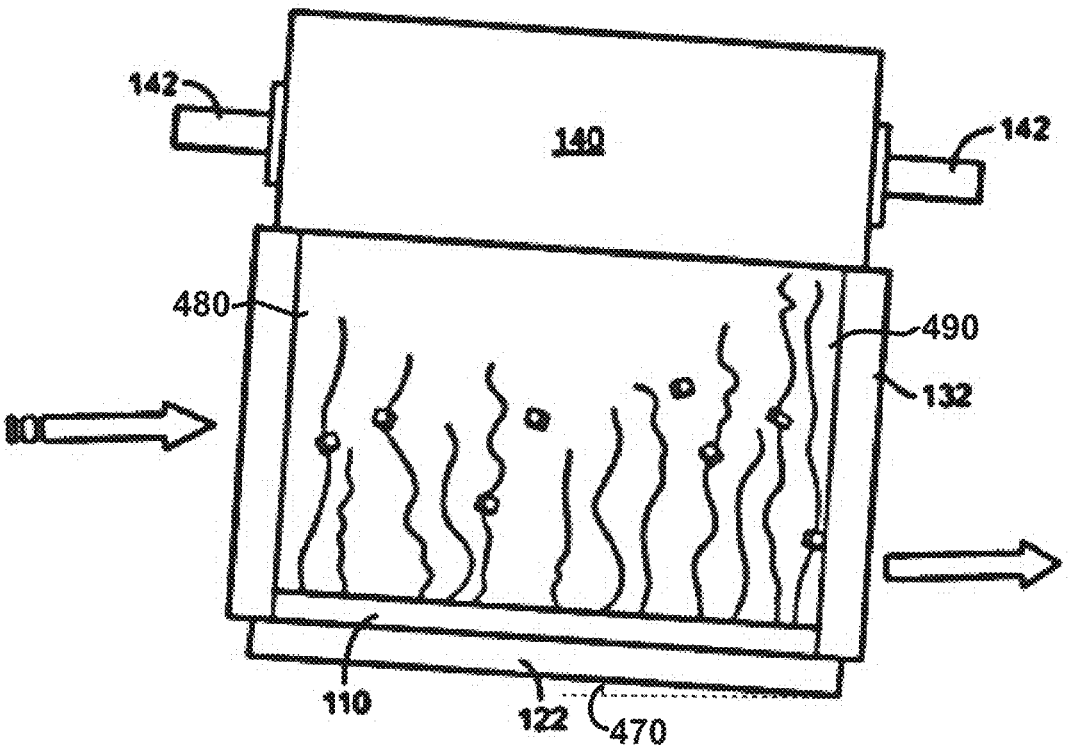
FIG. 4 depicts a side view of the exemplary apparatus of FIG. 1 showing how the apparatus can be tilted to adjust flow.

In addition to structures that inhibit product portions 220 from falling out of polymer enrobing zone 200, machines provided herein can include additional features that guide product portions 220 along a desired path while levitated in polymer enrobing zone 200. In some cases, such as shown in FIG. 4, the machine can be tilted such that polymer spray head 110 is tilted at an angle 470. Levitated product portions 220 can thus preferentially move from an introduction point 480 at a first side of polymer enrobing zone 200 above a side of polymer spray head 110 having a higher elevation to a collection point 490 at a second side of polymer enrobing zone 200 above a side of polymer spray head 110 having a lower elevation. In some cases, side guide conveyors 132 and 134 can move in a direction towards collection point 490 of polymer enrobing zone 200.

In some cases, polymer spray head 110 is inclined such that a product portion 220 introduced to the polymer enrobing zone at introduction point 480 above a side of polymer spray head 110 having a higher elevation will preferentially exit polymer enrobing zone 200 at the collection point 490 of polymer enrobing zone 200 above a side of the polymer spray head 110 having a lower elevation. In some cases, polymer spray head 110 can be inclined at an angle of between 5 degrees and 30 degrees. In some cases, apparatus 100 includes an adjustable tilt adapted to adjust an incline of the apparatus. In some cases, the tilt can be adjusted to tilt polymer spray head 110 at multiple angles between 0 degrees and 50 degrees, between 5 degrees and 30 degrees, or between 10 degrees and 20 degrees. In some cases, polymer spray head 110 can direct polymeric fibers 210 at an angle of less than 90 degrees from polymer spray head 110 to impart a directional flow of polymeric fibers 210 in polymer enrobing zone 200 in order to encourage product portions 220 introduced at a first end of polymer enrobing zone 200 to exit at an opposite end of polymer enrobing zone 200. For example, spinnerets (e.g., spinnerets 629 in FIG. 6) can be angled at an angle of between 85 degrees and 45 degrees from the surface.

Polymer Collection Roller

Although polymeric fibers 210 in polymer enrobing zone 200 do wrap around and enrobe product portions 220 levitated therein, some polymeric fibers 210 can sometimes miss the levitated product portions 220. Methods and machines provided herein can use any suitable method or device to collect and dispose of polymeric fibers that pass through polymer enrobing zone 200 without becoming wrapped around a product portion 220. In some cases, such as shown in FIGS. 1-4, methods and machines provided herein can include and/or use a polymer collection roller 140 to collect polymeric fibers 210 that pass through polymer enrobing zone 200. Polymer collection roller 140 can be rotated about an axis to collect the polymeric fibers 210 as a non-woven fabric. In some cases, the polymeric fiber non-woven fabric collected on the polymer collection roller can be recycled and/or used to make additional products.

Enrobed Product Portions

Methods and machines provided herein can be used to enrobe any suitable product portion. Methods and machines provided herein can be useful to coat and contain any fragile body. Exemplary products that can be enrobed in polymeric fibers using a method or machine provided herein include smokeless tobacco products and smokeless tobacco substitutes, herbal and spice products, and teas and other beverage producing mixtures. Polymeric-fiber enrobed smokeless tobacco portions are described below. Smokeless tobacco substitutes can include herbal products that provide a satisfying flavor without tobacco and/or nicotine. For example, in some cases, mixtures of herbs and spices (with or without nicotine) can provide an adult tobacco consumer with a flavor and tactile experience similar to the use of a smokeless tobacco product. In some cases, cellulosic fibers can be mixed with flavors, nicotine, and other additives to provide a flavor and tactile experience similar to the use of a smokeless tobacco product. In some cases, herbal and/or spice mixes can be enrobed in polymeric fibers in a method or machine provided herein to be used in preparing meals and/or beverages. For example, a spice package for a stew can include ingredients such as bay leaf that should be removed from the stew after cooking. In some cases, herbal beverages (e.g., black tea, green tea, coffee, etc.) can be enrobed in polymeric fibers using a method and/or machine provided herein to provide an herbal beverage brewing bag (e.g., a tea bag, coffee pod).

Suitable herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, *Echinacea*, Elderberry, Willow bark). In some cases, the tobacco is replaced with a mixture of non-tobacco plant material. Such non-tobacco compositions may have a number of different primary ingredients, including but not limited to, tea leaves, coffee, red clover, coconut flakes, mint leaves, *ginseng*, apple, corn silk, grape leaf, and basil leaf. The plant material typically has a total oven volatiles content of about 10% by weight or greater; e.g., about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight.

Polymeric Fiber Enrobed Smokeless Tobacco Product Portion

Figure 5:
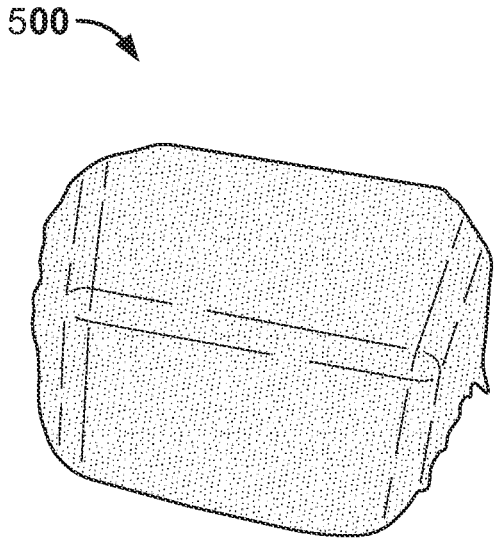
FIG. 5 depicts a perspective view of an embodiment of a fiber-wrapped smokeless tobacco product with a predetermined shape.

A fiber-wrapped smokeless tobacco portion can retain the smokeless tobacco fibers when placed in a mouth of an adult tobacco consumer, yet allow the flavors and substances of the tobacco pass through the polymeric fibers. FIG. 5 depicts an exemplary polymeric fiber enrobed smokeless tobacco portions 500. In some cases, polymeric fibers on polymeric fiber enrobed smokeless tobacco portion 500 have a diameter of less than 100 microns. Polymeric fibers 210 wrapped around the smokeless tobacco can form a moisture-permeable porous surface that can provide a unique tactile and flavor experience to an adult tobacco consumer. In particular, polymeric fibers 210 can provide a smooth mouth texture, bind/encase/encapsulate the smokeless tobacco during use, but give the adult tobacco consumer good access to the smokeless tobacco and any flavor contained therein. As compared to a typical pouch paper, the polymeric fibers can be softer, be free of seams, have a lower basis weight, act as less of a selective membrane, be chewable, and have greater moldability/manageability.

The methods and machines provided herein can be used to produce a polymeric fiber enrobed smokeless tobacco portion 500 that remains cohesive and are less likely to break apart during packaging, handling, shipping, and during use by adult tobacco consumers. In some cases, polymeric fibers 210 can provide a soft and highly porous coating around the smokeless tobacco. Methods and machines provided herein can enrobe and/or wrap smokeless tobaccos that are not suitable for being pouched using a typical pouching operation, for example smokeless tobaccos having an average aspect ratio of greater than 3 (e.g., long-cut smokeless tobacco) and/or high moisture tobacco (e.g., a tobacco having an OV content of greater than 47 weight percent).

The described combinations of the polymeric material and smokeless tobacco can provide a softer mouth feel. Moreover, in some cases, the polymeric material can be elastic or pliable (e.g., a polymeric polyurethane such as DESMOPAN DP 9370A or TEXIN available from Bayer) thus forming a smokeless tobacco product that can tolerate being "worked" (e.g., chewed or squeezed) in the mouth without the tobacco dispersing within the mouth. For example, the smokeless tobacco product can be worked to provide flavor and/or to comfortably conform between the cheek and gum. In some cases, combinations of mouth-stable and mouth-dissolvable polymeric materials are combined with a body including smokeless tobacco material to provide a product that becomes looser after being placed in a mouth of an adult tobacco consumer, yet remains generally cohesive. Polymeric structural fibers can also be a composite of multiple materials, which may include both mouth-stable and mouth-dissolvable materials.

Polymeric fiber enrobed smokeless tobacco portion 500 can include polymeric structural fibers formed of polymeric fibers 210 deposited using a method or machine provided herein that forms a nonwoven network against and around a body of smokeless tobacco material. As used herein, the term "nonwoven" means a material made from fibers that are connected by entanglement and/or bonded together by a chemical, heat, or solvent treatment where the material does not exhibit the regular patterns of a woven or knitted fabric. Polymeric fiber enrobed smokeless tobacco portions 500 can also be dimensionally stable. As used herein, "dimensionally stable" means that the fiber-wrapped smokeless tobacco product retains its shape under its own weight. In some cases, polymeric fiber enrobed smokeless tobacco portions 500 are flexible, yet can be picked up at one end without the force of gravity causing the polymeric fiber enrobed smokeless tobacco portions 500 to bend or sag. In some cases, polymeric fiber enrobed smokeless tobacco portions 500 can be easily deformable.

Individual product portions 220 of smokeless tobacco for use in a method or machine provided herein can be made using any suitable method. For example, smokeless tobacco can be added to a mixer and mixed with optional binder(s), and optional flavorants, and/or other additives. For example, the smokeless tobacco can be long cut tobacco having an oven volatiles content of 10-61 weight percent. In some cases, an added binder can be TICALOID LITE Powder. In some cases, an added flavorants and/or other additives can include, for example, a mint flavoring, a sweetener, and a pH modifier. The mixing can occur in any commercially available countertop mixer or industrial mixer, for example a HOBART 40 lbs mixer or a FORBERG 250 lbs Paddle Mixer. Water can be added to the tobacco prior to or during the mixing process to alter the total oven volatiles content. The oven volatiles content can also be modified by heating the mixture. In some cases, a commercially available smokeless tobacco product (e.g., SKOAL Long Cut) can be mixed with a binder (e.g., TICALOID LITE Powder) to form the mixture, which can then be shaped into one or more bodies used as product portions 220 in methods and machines provided herein.

In some cases, bodies of smokeless tobacco used as product portions 220 in methods and machines provided herein can have less than 1% by weight of binder, less than 0.5% by weight of binder, less than 0.3% by weight of binder, less than 0.2% by weight of binder, less than 0.1% by weight of binder, or less than 0.05% by weight of binder. In some cases, bodies of smokeless tobacco used as product portions 220 in methods and machines provided herein include one or more binders, such as a hydrocolloid, in an amount of between 0.05 weight percent and 0.8 weight percent. In some cases, bodies of smokeless tobacco used as product portions 220 in methods and machines provided herein include between 0.1 and 0.5 weight percent binder. For example, bodies of smokeless tobacco used as product portions 220 in methods and machines provided herein can include between 0.2 and 0.4 weight percent of a binder that includes guar gum, xanthan gum, cellulose gum, or similar materials or a combination thereof.

The molding of a product portion 220 out of smokeless tobacco can include depositing a smokeless tobacco containing mixture into a mold. In some cases, a smokeless tobacco containing mixture is deposited into an open mold plate including a plurality of identically shaped cavities. A molding process can include applying pressure to a smokeless tobacco containing mixture. This pressure can be applied as injection pressure applied to the mixture as it is forced into a closed cavity or by compressing each cavity filled with the mixture. The pressure used during the molding process impacts that amount of compression experienced by the mixture and thus the material properties of the mixture. In some cases, 50-300 lbs. of injection pressure is used to deliver a smokeless tobacco containing mixture into a plurality of mold cavities. The molds can be filled with continuous or intermittent pressure. A screw pump can be used to apply the pressure to a smokeless tobacco containing mixture. For example, a FORMAX® machine (e.g., the FORMAX F-6 and F-19 units) can be used to inject a smokeless tobacco containing mixture into cavities in a mold plate. For example, such a process is described in U.S. Patent Application Publication No. 2012/0024301, which is hereby incorporated by reference. In some cases, the mold cavities have a volume sized to create shaped smokeless tobacco bodies having a mass of, for example, about 2.35 grams. The edges and corners of the mold can be rounded to permit the shaped smokeless tobacco bodies to be easily released from the mold and be comfortable in the mouth of an adult tobacco consumer. In some cases, a molding step can include extruding smokeless tobacco material (optionally with binders, flavorants, and other additives) and cutting the extruded smokeless tobacco material to form product portions 220. In some cases, enrobed product portions produced in methods and/or machines provided herein can be rewet with water and/or a solution of flavorants, sweeteners, and/or other additives discussed herein to wick the coating of polymeric fibers, provide a moist appearance, prove a flavor immediately, and/or to increase a flavor intensity.

The polymer used in polymeric fiber enrobed smokeless tobacco portion 500 can be any of the polymers discussed above. In some cases, polymeric fiber enrobed smokeless tobacco portion 500 is polyurethane and/or polypropylene. Binders suitable for use in the polymeric fiber enrobed smokeless tobacco portion 500 provided herein include orally compatible polymers, such as cellulosics (e.g., carboxymethyl cellulose (CMC), hydroxypropyl cellulose (HPC), hydroxyethyl cellulose (HEC), hydroxypropyl methyl cellulose (HPMC), and methyl cellulose (MC)); natural polymers (e.g., starches and modified starches, konjac, collagen, inulin, soy protein, whey protein, casein, and wheat gluten); seaweed-derived polymers (e.g., carrageenan (kappa, iota, and lambda); alginates, (and propylene glycol alginate), microbial-derived polymers (e.g., xanthan, dextrin, pullulan, curdlan, and gellan); extracts (e.g., locust bean gum, guar gum, tara gum, gum tragacanth, pectin (lo methoxy and amidated), agar, zein, karaya, gelatin, psyllium seed, chitin, and chitosan), exudates (e.g., gum acacia (arabic) and shellac), synthetic polymers (e.g., polyvinyl pyrrolidone, polyethylene oxide, and polyvinyl alcohol. Flavors and other additives can be included in polymeric fiber enrobed smokeless tobacco portion 500 described herein and can be added to polymeric fiber enrobed smokeless tobacco portion 500 at any point in the process of making the polymeric fiber enrobed smokeless tobacco portion 500. Suitable flavorants include wintergreen (e.g., methyl salicylate), cherry and berry type flavorants, various liqueurs and liquors such as Drambuie, bourbon, scotch, whiskey, spearmint, peppermint, lavender, cinnamon, cardamon, apium graveolens, clove, cascarilla, nutmeg, sandalwood, bergamot, geranium, honey essence, rose oil, vanilla, lemon oil, orange oil, Japanese mint, cassia, caraway, cognac, jasmine, chamomile, menthol, ylang-ylang, sage, fennel, piment, ginger, anise, coriander, coffee, licorice, and mint oils from a species of the genus Mentha. Mint oils useful in some cases of the fiber-wrapped smokeless tobacco products include spearmint and peppermint. Flavorants can also be included in the form of flavor beads (e.g., flavor capsules, flavored starch beads, flavored gelatin beads), which can be dispersed within the fiber-wrapped smokeless tobacco product (e.g., in a nonwoven network of polymeric structural fibers). For example, the fiber-wrapped smokeless tobacco product could include the beads described in U.S. Patent Application Publication 2010/0170522, which is hereby incorporated by reference. Other optional additives include as fillers (e.g., starch, di-calcium phosphate, lactose, beet fiber (FIBREX) sorbitol, mannitol, and microcrystalline cellulose), soluble fiber (e.g., FIBERSOL from Matsushita), calcium carbonate, dicalcium phosphate, calcium sulfate, and clays), lubricants (e.g., lecithin, stearic acid, hydrogenated vegetable oil, canola oil, mineral oil, polyethylene glycol 4000-6000 (PEG), sodium lauryl sulfate (SLS), glyceryl palmitostearate, sodium benzoate, sodium stearyl fumarate, talc, and stearates (e.g., Mg or K), and waxes (e.g., glycerol monostearate, propylene glycol monostearate, and acetylated monoglycerides), plasticizers (e.g., glycerine), propylene glycol, polyethylene glycol, sorbitol, mannitol, triacetin, and 1,3 butane diol), stabilizers (e.g., ascorbic acid and monosterol citrate, BHT, or BHA), artificial sweeteners (e.g., sucralose, saccharin, and aspartame), disintegrating agents (e.g., starch, sodium starch glycolate, cross carmellose, cross linked PVP), pH stabilizers, salt, or other compounds (e.g., vegetable oils, surfactants, and preservatives). Some compounds display functional attributes that fall into more than one of these categories. For example, propylene glycol can act as both a plasticizer and a lubricant and sorbitol can act as both a filler and a plasticizer.

Smokeless tobacco is tobacco suitable for use in an orally used tobacco product. By "smokeless tobacco" it is meant a part, e.g., leaves, and stems, of a member of the genus *Nicotiana* that has been processed. Exemplary species of tobacco include *N. rustica, N. tabacum, N. tomentosiformis*, and *N. sylvestris*. Suitable tobaccos include fermented and unfermented tobaccos. In addition to fermentation, the tobacco can also be processed using other techniques. For example, tobacco can be processed by heat treatment (e.g., cooking, steam treating, toasting), flavoring, enzyme treatment, expansion, and/or curing. For example, tobacco can be conditioned by heating, sweating and/or pasteurizing steps as described in U.S. Publication Nos. 2004/0118422 or 2005/0178398. Both fermented and non-fermented tobaccos can be processed using these techniques. In some cases, the tobacco can be unprocessed tobacco. Specific examples of suitable processed tobaccos include, dark air-cured, dark fire-cured, burley, flue cured, and cigar filler or wrapper, as well as the products from the whole leaf stemming operation. In some cases, smokeless tobacco includes up to 70% dark tobacco on a fresh weight basis. Fermenting typically is characterized by high initial moisture content, heat generation, and a 10 to 20% loss of dry weight. See, e.g., U.S. Pat. Nos. 4,528,993; 4,660,577; 4,848,373; and 5,372,149. In addition to modifying the aroma of the leaf, fermentation can change the color, texture, taste, and sensorial attributes of a leaf. Also during the fermentation process, evolution gases can be produced, oxygen can be taken up, the pH can change, and the amount of water retained can change. See, for example, U.S. Publication No. 2005/0178398 and Tso (1999, Chapter 1 in Tobacco, Production, Chemistry and Technology, Davis & Nielsen, eds., Blackwell Publishing, Oxford). Cured, or cured and fermented tobacco can be further processed (e.g., cut, expanded, blended, milled or comminuted) prior to incorporation into the smokeless tobacco product. The tobacco, in some cases, is long cut fermented cured moist tobacco having an oven volatiles content of between 10 and 61 weight percent prior to mixing with the polymeric material and optionally flavorants and other additives.

The tobacco can, in some cases, be prepared from plants having less than 20 μg of DVT per $cm^2$ of green leaf tissue. For example, the tobacco particles can be selected from the tobaccos described in U.S. Patent Publication No. 2008/0209586, which is hereby incorporated by reference. Tobacco compositions containing tobacco from such low-DVT varieties exhibits improved flavor characteristics in sensory panel evaluations when compared to tobacco or tobacco compositions that do not have reduced levels of DVTs.

The smokeless tobacco can be processed to a desired size. For example, long cut smokeless tobacco typically is cut or shredded into widths of about 10 cuts/inch up to about 110 cuts/inch and lengths of about 0.1 inches up to about 1 inch. Double cut smokeless tobacco can have a range of particle sizes such that about 70% of the double cut smokeless tobacco falls between the mesh sizes of −20 mesh and 80 mesh. Other lengths and size distributions are also contemplated.

The smokeless tobacco can have a total oven volatiles content of about 10% by weight or greater; about 20% by weight or greater; about 40% by weight or greater; about 15% by weight to about 25% by weight; about 20% by weight to about 30% by weight; about 30% by weight to about 50% by weight; about 45% by weight to about 65% by weight; or about 50% by weight to about 60% by weight. Those of skill in the art will appreciate that "moist" smokeless tobacco typically refers to tobacco that has an oven volatiles content of between about 40% by weight and about 60% by weight (e.g., about 45% by weight to about 55% by weight, or about 50% by weight). As used herein, "oven volatiles" are determined by calculating the percentage of weight loss for a sample after drying the sample in a pre-warmed forced draft oven at 110 degrees C. for 3.25 hours. The fiber-wrapped smokeless tobacco product can have a different overall oven volatiles content than the oven volatiles content of the smokeless tobacco used to make the fiber-wrapped smokeless tobacco product. The processing steps described herein can reduce or increase the oven volatiles content. The overall oven volatiles content of the fiber-wrapped smokeless tobacco product is discussed below.

Polymeric fiber enrobed smokeless tobacco portion 500 can include between 15 weight percent and 85 weight percent smokeless tobacco on a dry weight basis. The amount of smokeless tobacco in polymeric fiber enrobed smokeless tobacco portion 500 on a dry weight basis is calculated after drying polymeric fiber enrobed smokeless tobacco portion 500 in a pre-warmed forced draft oven at 110 degrees Celsius for 3.25 hours. The remaining non-volatile material is then separated into tobacco material and polymeric material. The percent smokeless tobacco in the fiber-wrapped smokeless tobacco product is calculated as the weight smokeless tobacco divided by the total weight of the non-volatile materials. In some cases, the fiber-wrapped smokeless tobacco product includes between 20 and 60 weight percent tobacco on a dry weight basis. In some cases, polymeric fiber enrobed smokeless tobacco portion 500 includes at least 28 weight percent tobacco on a dry weight basis. For example, polymeric fiber enrobed smokeless tobacco portion 500 can include a total oven volatiles content of about 57 weight percent, about 3 weight percent polymeric material, and about 40 weight percent smokeless tobacco on a dry weight basis.

Polymeric fiber enrobed smokeless tobacco portion 500 can have a total oven volatiles content of between 10 and 61 weight percent. In some cases, the total oven volatiles content is at least 40 weight percent. The oven volatiles include water and other volatile compounds, which can be a part of the tobacco, the polymeric material, the flavorants, and/or other additives. As used herein, the "oven volatiles" are determined by calculating the percentage of weight loss for a sample after drying the sample in a pre-warmed forced draft oven at 110 degrees Celsius for 3.25 hours. Some of the processes may reduce the oven volatiles content (e.g., heating the composite or contacting the smokeless tobacco with a heated polymeric material), but the processes can be controlled to have an overall oven volatiles content in a desired range. For example, water and/or other volatiles can be added back to the fiber-wrapped smokeless tobacco product to bring the oven volatiles content into a desired range. In some cases, the oven volatiles content of polymeric fiber enrobed smokeless tobacco portion 500 is between 4 and 61 weight percent. In some cases, the oven volatiles content of polymeric fiber enrobed smokeless tobacco portion 500 is between 47 and 61 weight percent. For example, the oven volatiles content of smokeless tobacco used in the various processed described herein can be about 57 weight percent. In some cases, the oven volatiles content can be between 10 and 30 weight percent.

Some embodiments of a smokeless tobacco system can include one or more polymeric fiber enrobed smokeless tobacco portion 500. A plurality of polymeric fiber enrobed smokeless tobacco portions 500 can be arranged in an interior space of a bottom container that mates with a lid. The plurality of the polymeric fiber enrobed smokeless tobacco portions 500 arranged in the container can all have a substantially similar shape so that an adult tobacco consumer can conveniently select any of the similarly shaped polymeric fiber enrobed smokeless tobacco portions 500 therein and receive a generally consistent portion of the smokeless tobacco.

An exemplary shape of a polymeric fiber enrobed smokeless tobacco portion 500 provided herein is shown in FIG. 5, which depicts a perspective view of polymeric fiber enrobed smokeless tobacco portion 500 having a substantially rectangular cuboidal shape with rounded corners in the longitudinal (lengthwise) plane. In some cases, polymeric fiber enrobed smokeless tobacco portion 500 has a substantially rectangular cuboidal shape having a length of between 15 mm and 50 mm, a width of between 5 mm and 20 mm, and a thickness of between 3 mm and 12 mm. For example, a substantially rectangular cuboidal shape could have a length of between 26 mm and 30 mm, a width of between 10 mm and 12 mm, and a thickness of between 6 mm and 8 mm. A product having a length of 28 mm, a width of 11 mm, and thickness of 7 mm could have a product weight of about 2.35 g. In other embodiments, a substantially rectangular cuboidal shape could have a length of between 18 and 21 mm, a width of between 10 mm and 12 mm, and a thickness of between 9 mm and 11 mm. In some cases, the preformed smokeless tobacco product 500 can be cube shaped. Other shapes and sizes are also contemplated. For example, polymeric fiber enrobed smokeless tobacco portion 500 can be configured to be: (A) an elliptical shaped fiber-wrapped smokeless tobacco product; (B) an elongated elliptical shaped fiber-wrapped smokeless tobacco product; (C) a semi-circular fiber-wrapped smokeless tobacco product; (D) a square- or rectangular-shaped fiber-wrapped smokeless tobacco product; (E) a football-shaped fiber-wrapped smokeless tobacco product; (F) an elongated rectangular-shaped fiber-wrapped smokeless tobacco product; (G) boomerang-shaped fiber-wrapped smokeless tobacco product; (H) a rounded-edge rectangular-shaped fiber-wrapped smokeless tobacco product; (I) teardrop- or comma-shaped fiber-wrapped smokeless tobacco product; (J) bowtie-shaped fiber-wrapped smokeless tobacco product; and (K) peanut-shaped fiber-wrapped smokeless tobacco product. Polymeric fiber enrobed smokeless tobacco portion 500 can have different thicknesses or dimensionality, such that a beveled fiber-wrapped smokeless tobacco product (e.g., a wedge) is produced or a hemi-spherical shape is produced.

OTHER EMBODIMENTS

It is to be understood that, while the invention has been described herein in conjunction with a number of different aspects, the foregoing description of the various aspects is intended to illustrate and not limit the scope of the invention, which is defined by the scope of the appended claims. Other aspects, advantages, and modifications are within the scope of the following claims.

Disclosed are methods and compositions that can be used for, can be used in conjunction with, can be used in preparation for, or are products of the disclosed methods and compositions. These and other materials are disclosed herein, and it is understood that combinations, subsets, interactions, groups, etc. of these methods and compositions are disclosed. That is, while specific reference to each various individual and collective combinations and permutations of these compositions and methods may not be explicitly disclosed, each is specifically contemplated and described herein. For example, if a particular composition of matter or a particular method is disclosed and discussed and a number of compositions or methods are discussed, each and every combination and permutation of the compositions and the methods are specifically contemplated unless specifically indicated to the contrary. Likewise, any subset or combination of these is also specifically contemplated and disclosed.

What is claimed is:

1. An apparatus comprising a polymer spray head configured to direct a plurality of polymeric fibers in a first direction and levitate a product portion in a polymer enrobing zone; and a guide configured to help retain the product portion in the polymer enrobing zone, the guide including, a first air knife and a second air knife, the first air knife and the second air knife on opposite sides of the polymer enrobing zone, and a first guide structure and a second guide structure, the first guide structure and the second guide structure on opposite sides of the polymer enrobing zone.

2. The apparatus of claim 1, wherein the guide is disposed adjacent to the polymer enrobing zone.

3. The apparatus of claim 1, wherein the first guide structure comprises a first conveyor configured to move a first conveyor belt in a second direction substantially orthogonal to the first direction, and the second guide structure comprises a second conveyor configured to move a second conveyor belt in the second direction.

4. The apparatus of claim 1, wherein the first air knife and the second air knife are configured to direct a flow of air adjacent to the polymer enrobing zone to create air walls.

5. The apparatus of claim 4, wherein the first air knife and the second air knife are configured to direct the flow of air in substantially the first direction.

6. The apparatus of claim 1, wherein the first guide structure is farther from the polymer enrobing zone than the first air knife, and the second guide structure is farther from the polymer enrobing zone than the second air knife.

7. The apparatus of claim 1, further comprising:

a polymer collection roller, the polymer collection roller being configured to collect at least some polymeric fibers of the plurality of polymeric fibers that are not wrapped around the product portion.

8. The apparatus of claim 1, wherein the polymer spray head defines an elongated shape.

9. The apparatus of claim 8, wherein the polymer spray head is disposed at an incline such that a first end of the polymer spray head is disposed at a higher elevation than a second end of the polymer spray head.

10. The apparatus of claim 9, wherein the polymer spray head is configured to direct the product portion from the first end to the second end.

11. The apparatus of claim 9, wherein the incline defines an angle having a magnitude ranging from 0 degrees to 50 degrees.

12. The apparatus of claim 11, wherein the magnitude is configured to be adjusted.

13. The apparatus of claim 11, wherein the magnitude ranges from 5 degrees to 30 degrees.

14. The apparatus of claim 13, wherein the magnitude ranges from 10 degrees to 20 degrees.

15. The apparatus of claim 1, wherein the polymer spray head is configured to direct a flow of air in substantially the first direction.

16. The apparatus of claim 1, wherein the polymer spray head comprises a melt blowing device.

17. The apparatus of claim 1, wherein the polymer spray head comprises an electrospinning apparatus.

18. The apparatus of claim 1, wherein the polymer spray head comprises a force spinning apparatus.

19. The apparatus of claim 1, further comprising:

a spout configured to direct a mist toward the plurality of polymeric fibers, the mist including one or more of water, a surfactant, a sweetener, a flavorant, or any combination thereof.

20. The apparatus of claim 1, wherein the polymer spray head is configured to direct the polymeric fibers at an angle with respect to a surface of the polymer spray head, a magnitude of the angle being less than 90 degrees.

21. The apparatus of claim 20, wherein the magnitude ranges from 45 degrees to 85 degrees.

* * * * *